US008028614B2

(12) United States Patent
Terauchi

(10) Patent No.: US 8,028,614 B2
(45) Date of Patent: Oct. 4, 2011

(54) WOBBLE PLATE COMPRESSOR

(75) Inventor: Kiyoshi Terauchi, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 631 days.

(21) Appl. No.: 12/067,886

(22) PCT Filed: Jul. 24, 2006

(86) PCT No.: PCT/JP2006/314547

§ 371 (c)(1),
(2), (4) Date: Mar. 24, 2008

(87) PCT Pub. No.: WO2007/037061

PCT Pub. Date: Apr. 5, 2007

(65) Prior Publication Data

US 2009/0139396 A1 Jun. 4, 2009

(30) Foreign Application Priority Data

Sep. 27, 2005 (JP) ..... 2005-279453

(51) Int. Cl.
*F01B 3/02* (2006.01)
*F16J 1/22* (2006.01)

(52) U.S. Cl. ..... 92/12.2; 92/188

(58) Field of Classification Search ..... 92/12.2, 92/71, 188

See application file for complete search history.

(56) References Cited

U.S. PATENT DOCUMENTS

| | | | | |
|---|---|---|---|---|
| 4,617,853 | A * | 10/1986 | Wagenseil et al. | 92/12.2 |
| 5,063,829 | A * | 11/1991 | Takao et al. | 92/71 |
| 5,239,913 | A | 8/1993 | Terauchi | |
| 2003/0086792 | A1 | 5/2003 | Kamiya et al. | |

FOREIGN PATENT DOCUMENTS

| | | | |
|---|---|---|---|
| DE | 1110479 | B | 7/1961 |
| DE | 19937110 | A1 | 2/2000 |
| GB | 915498 | A | 10/2008 |
| JP | H05-010256 | A | 1/1993 |
| JP | H05-033763 | A | 2/1993 |
| JP | H05-099146 | A | 4/1993 |
| JP | 2000-345958 | A | 12/2000 |
| JP | 2001-041155 | A | 2/2001 |
| JP | 2004-132327 | A | 4/2004 |
| WO | 01/36822 | A1 | 5/2001 |

* cited by examiner

*Primary Examiner* — Daniel Lopez
(74) *Attorney, Agent, or Firm* — Baker Botts L.L.P.

(57) ABSTRACT

An object of the present invention is to provide a wobble plate compressor equipped with a mechanism for preventing the rotation of the wobble plate which is simply structured, producible at low cost, and does not cause heavy noise or vibration.

A wobble plate compressor comprises a main shaft driven by a power source, a wobble plate driven by the main shaft to swing, a piston connected to the wobble plate by a connecting rod, and a cylinder bore extending parallel to the main shaft to accept the piston. The connecting rod is connected to the wobble plate by a ball joint, precession of the connecting rod is allowed when the piston moves reciprocally, and the outer circumferential surface of the piston is forced against the inner circumferential surface of the cylinder bore when the wobble plate is driven by the main shaft to rotate and the connecting rod is driven by the rotating wobble plate to swing beyond the range of the precession. Thus, rotation of the wobble plate is prevented.

5 Claims, 4 Drawing Sheets

WOBBLE PLATE COMPRESSOR

CROSS-REFERENCE TO RELATED APPLICATION

This application is the National Stage of International Patent Application No. PCT/JP2006/314547, filed Jul. 24, 2006, which claims the benefit of Japanese Patent Application No. 2005-279453, filed Sep. 27, 2005, the disclosures of which are incorporated herein by reference.

TECHNICAL FIELD

The present invention relates to a wobble plate compressor.

BACKGROUND ART

A wobble plate compressor comprising a main shaft driven by a power source, a wobble plate driven by the main shaft to swing, a piston connected to the wobble plate by a connecting rod, and a cylinder bore extending parallel to the main shaft to accept the piston is well known. The wobble plate compressor is equipped with a mechanism for preventing rotation of the wobble plate. Patent document 1 discloses a mechanism for preventing rotation of the wobble plate comprising a guide rod and a clamping member slidably engaging the guide rod. Patent document 2 discloses a mechanism for preventing rotation of the wobble plate comprising a pair of bevel gears engaging each other. Patent document 3 discloses a mechanism for preventing rotation of the wobble plate comprising a ball joint provided with a key and a key groove.

Patent document 1: Japanese Patent Laid-Open Publication No. 5-10256

Patent document 2: Japanese Patent Laid-Open Publication No. 5-33763

Patent document 3: Japanese Patent Laid-Open Publication No. 2000-345958

DISCLOSURE OF INVENTION

Problems to be Solved

The mechanisms for preventing wobble plate rotation disclosed in Patent documents 1 to 3 have problems in that vibration is caused by ununiform motion of the wobble plate, noise is caused by engagement of the pair of gears, structure is complicated, manufacturing cost is high, etc.

An object of the present invention is to provide a wobble plate compressor equipped with a mechanism for preventing the rotation of the wobble plate which is simply structured, producible at low cost, and does not cause heavy noise or vibration.

Means for Solving the Problems

In accordance with the present invention, there is provided a wobble plate compressor comprising a main shaft driven by a power source, a wobble plate driven by the main shaft to swing, a piston connected to the wobble plate by a connecting rod, and a cylinder bore extending parallel to the main shaft to accept the piston, wherein the connecting rod is connected to the wobble plate by a ball joint, precession of the connecting rod is allowed when the piston moves reciprocally, and the outer circumferential surface of the piston is forced against the inner circumferential surface of the cylinder bore when the wobble plate is driven by the main shaft to rotate and the connecting rod is driven by the rotating wobble plate to swing beyond the range of the precession, thereby preventing rotation of the wobble plate.

The center of the ball joint connecting the connecting rod to the wobble plate reciprocally moves in the longitudinal direction of the main shaft and orbits with a small radius in the radial direction of the main shaft to cause precession of the connection rod. Therefore, allowance of the precession of the connecting rod enables smooth movement of the piston. When the wobble plate is driven by the main shaft to rotate, the rotation of the wobble plate is transmitted to the connecting rod through the ball joint to cause swing of the connecting rod beyond the range of the precession. When the connecting rod swings beyond the range of the precession, the outer circumferential surface of the piston is forced against the inner circumferential surface of the cylinder bore to prevent the swing of the connecting rod. When the swing of the connecting rod is prevented, the rotation of the wobble plate is prevented.

The mechanism for allowing the precession of the connecting rod and forcing the outer circumferential surface of the piston against the inner circumferential surface of the cylinder bore when the connecting rod swings beyond the range of the precession can be structured simply and produced at low cost. Prevention of rotation of the wobble plate causes no heavy noise or vibration because the rotation of the wobble plate is prevented by forcing the outer circumferential surface of the piston against the inner circumferential surface of the cylinder bore. Therefore, the present invention can provide a wobble plate compressor equipped with a mechanism for preventing the rotation of the wobble plate which is simply structured, producible at low cost, and does not cause heavy noise or vibration.

In accordance with a preferred embodiment of the present invention, the connecting rod is connected to the piston by a ball joint, a radial space is formed between the piston and the connecting rod to allow the precession of the connecting rod when the piston moves reciprocally, and the connecting rod abuts the piston to force it when the connecting rod is driven by the rotating wobble plate to swing beyond the range of the precession, thereby forcing the outer circumferential surface of the piston against the inner circumferential surface of the cylinder bore.

In accordance with a preferred embodiment of the present invention, the connecting rod is connected to the piston by a pin, a radial space is formed between the piston and the connecting rod to allow the precession of the connecting rod when the piston moves reciprocally, and the connecting rod abuts the piston to force it when the connecting rod is driven by the rotating wobble plate to swing beyond the range of the precession, thereby forcing the outer circumferential surface of the piston against the inner circumferential surface of the cylinder bore.

When the connecting rod is connected to the piston by a ball joint or a pin, the connecting rod moves relative to the piston because the connection between the connecting rod and the piston becomes the support point of the precession. Therefore, the connecting rod can precess if only a radial space for allowing the precession of the connecting rod during the reciprocal movement of the piston is formed between the piston and the connecting rod. When the wobble plate is driven by the main shaft to rotate, and the connecting rod is driven by the rotating wobble plate to swing beyond the range of the precession, the connecting rod swings beyond the radial space to abut the piston, thereby forcing the piston to force the outer circumferential surface of the piston against the inner circumferential surface of the cylinder bore. As a result, the swing of the connecting rod is prevented and the rotation of the wobble plate is prevented.

In accordance with a preferred embodiment of the present invention, the connecting rod is connected to the piston by a ball joint or a pin, a cylindrical member is fitted in and fixed to the piston to form a part of the piston, and the radial space for allowing the precession of the connecting rod during the reciprocal movement of the piston is formed between the cylindrical member and the connecting rod.

In accordance with a preferred embodiment of the present invention, the connecting rod is connected to the piston by a ball joint or a pin, the connecting rod is provided with a portion with large diameter, and the radial space for allowing the precession of the connecting rod during the reciprocal movement of the piston is formed between the piston and the portion of the connecting rod with large diameter.

The radial space between the piston and the connecting rod for allowing the precession of the connecting rod during the reciprocal movement of the piston can be formed between a cylindrical member fitted in and fixed to the piston to form a part of the piston and the connecting rod or between a large diameter portion of the connecting rod and the piston.

In accordance with a preferred embodiment of the present invention, the connecting rod is fixed to the piston, a radial space is formed between the outer circumferential surface of the piston and the inner circumferential surface of the cylinder bore to allow the precession of the connecting rod during the reciprocal movement of the piston, and the outer circumferential surface of the piston is forced against the inner circumferential surface of the cylinder bore when the connecting rod is driven by the rotating wobble plate to swing beyond the range of the precession.

When the connecting rod is fixed to the piston, the connecting rod and the piston do not move relatively but unitarily. Therefore, the connecting rod can precess if only a radial space is formed between the outer circumferential surface of the piston and the inner circumferential surface of the cylinder bore to allow the precession of the connecting rod during the reciprocal movement of the piston. When the connecting rod is driven by the rotating wobble plate to swing beyond the range of the precession, the piston moving unitarily with the connecting rod swings beyond the aforementioned radial space, and the outer circumferential surface of the piston is forced against the inner circumferential surface of the cylinder bore. As a result, the swing of the connecting rod is prevented and the rotation of the wobble plate is prevented.

In accordance with a preferred embodiment of the present invention, the connecting rod is fixed to the piston, a radial space is formed between the outer circumferential surface of the piston and the inner circumferential surface of the cylinder bore to allow the precession of the connecting rod during the reciprocal movement of the piston, and the piston is made of flexible material.

When the connecting rod is fixed to the piston and moves unitarily with the piston, the connecting rod can precess smoothly and the piston can reciprocally move smoothly if only the piston is made of flexible material to bend accompanying the precession of the connecting rod.

Effect of the Invention

In the present invention, when the wobble plate is driven by the main shaft to rotate, the rotation of the wobble plate is transmitted to the connecting rod through the ball joint to cause swing of the connecting rod beyond the range of the precession. When the connecting rod swings beyond the range of the precession, the outer circumferential surface of the piston is forced against the inner circumferential surface of the cylinder bore to prevent the swing of the connecting rod. When the swing of the connecting rod is prevented, the rotation of the wobble plate is prevented.

The mechanism for allowing the precession of the connecting rod and forcing the outer circumferential surface of the piston against the inner circumferential surface of the cylinder bore when the connecting rod swings beyond the range of the precession can be structured simply and produced at low cost. Prevention of rotation of the wobble plate causes no heavy noise or vibration because the rotation of the wobble plate is prevented by forcing the outer circumferential surface of the piston against the inner circumferential surface of the cylinder bore. Therefore, the present invention can provide a wobble plate compressor equipped with a mechanism for preventing the rotation of the wobble plate which is simply structured, producible at low cost, and does not cause heavy noise or vibration.

BEST MODE FOR CARRYING OUT THE INVENTION

Preferred embodiments of the present invention will be described.

As shown in FIG. 1, a variable displacement wobble plate compressor 100 comprises a main shaft 3, a rotor 10 fixed to the main shaft 3, a cam plate 1 connected to the rotor 10 to be tiltable relative thereto and a wobble plate 2 supported by the cam plate 1 through bearings 21 and 22 to be rotatable relative to the cam plate 1.

A connecting rod 5 is provided with a spherical portion 4 at one end. The wobble plate 2 is provided with a spherical concave. The connecting rod 5 is connected at one end to the wobble plate 2 by a ball joint 23 formed by the spherical concave of the wobble plate 2 and the spherical portion 4 of the connecting rod 5 slidably fitting in the spherical concave of the wobble plate 2.

The connecting rod 5 is provided with a spherical portion 8 at the other end. The spherical portion 8 is inserted in a piston 6 formed as a cylinder closed at one end. A cylindrical member 13 is fitted in the piston 6. The cylindrical member 13 is fixed to the piston 6 as clamped between the caulked open end 14 of the piston 6 and the spherical portion 8 of the connecting rod 5. The cylindrical member 13 forms a part of the piston 6. The cylindrical member 13 is provided with a concave at one end. The concave forms a part of a spherical surface. The piston 6 is provided with a semispherical concave at the closed end. The concave provided on the cylindrical member 13 and the semispherical concave provided on the piston 6 cooperate to form a substantially spherical concave. The connecting rod 5 is connected at the other end to the piston 6 by a ball joint 24 formed by the substantially spherical concave and the spherical portion 8 slidably fitted in the substantially spherical concave.

A small radial space 7 is formed between the cylindrical member 13 and the connecting rod 5.

The variable displacement wobble plate compressor 100 further comprises a cylinder bore 9 extending parallel to the main shaft 3. The piston 6 is inserted in the cylinder bore 9. One end of the cylinder bore 9 communicates with a crank chamber 15 for accommodating the main shaft 3, the rotor 10, the cam plate 1, the wobble plate 2, the bearings 21 and 22, etc. The other end of the cylinder bore 9 communicates with a suction chamber 11 through a suction hole 25 formed in a valve plate and a discharge chamber 12 through a discharge hole 26 formed in the valve plate. A suction valve for closing the suction hole 25 and a discharge valve for closing the discharge hole 26 are installed. The suction valve and the discharge valve are not shown in FIG. 1. A retainer 27 for restricting excessive movement of the discharge valve is installed in the discharge chamber 12.

One end of the main shaft 3 extends out of the crank chamber 15 to be connected to a power source through a power transmission mechanism, neither of which is shown in FIG. 1.

In the variable displacement wobble plate compressor 100, the main shaft 3 is driven by the power source to rotate, the rotor 10 and the cam plate 1 are driven by the main shaft 3 to rotate, the wobble plate 2 is driven by the cam plate 1 to swing, and the piston 6 connected to the wobble plate 2 by the connecting rod 5 is driven by the wobble plate 2 to move reciprocally in the cylinder bore 9. Accompanying the reciprocal movement of the piston 6, fluid is sucked into the cylinder bore 9 from the suction chamber 11 through the suction hole 25 and compressed in the cylinder bore 9. The compressed fluid is discharged from the cylinder bore 9 to the discharge chamber 12 through the discharge hole 26.

When the wobble plate 2 swings and the piston 6 moves reciprocally, the center of the ball joint 23 for connecting the connecting rod 25 to the wobble plate 5, more specifically, the center of the spherical portion 4, reciprocally moves in the longitudinal direction of the main shaft 3 and orbits with small radius in the radial direction of the main shaft 3. The orbital motion of the center of the spherical portion 4 causes precession of the connection rod 5 supported by the ball joint 24 connecting the connecting rod 5 to the piston 6 and motion of the connecting rod 5 relative to the piston 6. The small radial space 7 formed between the cylindrical member 13 and the connecting rod 5 prevents interference between the cylindrical member 13 and the connecting rod 5 to allow the precession of the connecting rod 5. The allowance of the precession of the connecting rod 5 leads to smooth movement of the piston 6.

When the wobble plate 2 is driven by the cam plate 1 to rotate, the rotation of the wobble plate 2 is transmitted to the connecting rod 5 through the ball joint 23 to cause swing of the connecting rod 5 beyond the range of the precession. As a result, the connecting rod 5 swings beyond the small radial space 7 to abut the cylindrical member 13 forming a part of the piston 6, thereby forcing the piston 6 to force the outer circumferential surface of the piston 6 against the inner circumferential surface of the cylinder bore 9. As a result, the swing of the connecting rod 5 is prevented and the rotation of the wobble plate 2 is prevented.

A mechanism for allowing the precession of the connecting rod 5 and preventing the rotation of the wobble plate 2 by forcing the outer circumferential surface of the piston 6 against the inner circumferential surface of the cylinder bore 9 when the connecting rod 5 swings beyond the range of the precession can be structured simply and produced at low cost by the cylindrical member 13 fitted in and fixed to the piston 6 and the small radial space 7 disposed between the cylindrical member 13 and the connecting rod 5.

Prevention of rotation of the wobble plate 2 does not cause heavy noise or vibration because the outer circumferential surface of the piston 6 is forced against the inner circumferential surface of the cylinder bore 9 to prevent the rotation of the wobble plate 2. The variable displacement wobble plate compressor 100 is thus equipped with a mechanism for preventing rotation of the wobble plate which is simply structured, producible at low cost, and does not cause heavy noise or vibration.

The cylindrical member 13 can be structured by a plurality of members or made of flexible material such as resin, etc. The piston 6 can be provided with a lubrication hole for supplying the ball joint 24 with lubrication oil. The cylindrical member 13 can be pressed into, or welded to, or adhered to the piston 6. The cylindrical member 13 can be formed integrally with the piston 6. The piston 6 can be coated with various kinds of lubricant. The piston 6 can be equipped with adequate number of piston rings.

The present invention can be applied to not only a variable displacement compressor, but also a fixed displacement compressor as shown in FIG. 2 or an electric compressor as shown in FIG. 3.

In a fixed displacement compressor 200 shown in FIG. 2, no cam plate is provided and a wobble plate 2 is directly driven by a rotor 10*a* fixed to a main shaft 3*a* to swing. Similarly to the variable displacement wobble plate compressor 100, one end of a connecting rod 5*a* is connected to the wobble plate 2 by a ball joint 23 provided with a spherical portion 4. However, the other end of the connecting rod 5*a* is fixed to a piston 6*a*. A small radial space 7*a* is formed between the outer circumferential surface of the piston 6*a* and the inner circumferential surface of a cylinder bore 9.

The connecting rod 5*a* and the piston 6*a* do not move relatively but unitarily because the connecting rod 5*a* is fixed to the piston 6*a* at the other end. Therefore, the connecting rod 5*a* and the piston 6*a* can precess if only the radial space 7*a* is formed between the outer circumferential surface of the piston 6*a* and the inner circumferential surface of the cylinder bore 9 to allow the precession of the connecting rod 5*a* during the reciprocal movement of the piston 6*a*. When the connecting rod 5*a* and the piston 6*a* is driven by the rotating wobble plate 2 to swing beyond the range of the precession, the piston 6*a* swings beyond the radial space 7*a*, and the outer circumferential surface of the piston 6*a* is forced against the inner circumferential surface of the cylinder bore 9. As a result, the swing of the connecting rod 5*a* is prevented and the rotation of the wobble plate 2 is prevented.

In an electric compressor 300 shown in FIG. 3, a main shaft 3*b* is driven by a built-in electric motor 31. No cam plate is equipped. Displacement of the compressor is fixed. The structures of a piston 6, a connecting rod 5 and ball joints 23 and 24 are the same as those of the variable displacement wobble plate compressor 100.

Other preferred embodiments are shown in FIGS. 4 to 6.

In a preferred embodiment shown in FIG. 4, a piston 6*b* is provided with a concave formed by a caulking 41. The concave forms a part of a spherical surface. The piston 6*b* has a cylindrical shape closed at one end and is provided with a semispherical concave at the closed end. The concave formed by the caulking 41 and the semispherical concave provided on the closed end cooperate to form a substantially spherical concave. The other end of the connecting rod 5*b* is connected to the piston 6*b* by a ball joint formed by the substantially spherical concave and a spherical portion 8 slidably fitted therein.

The connecting rod 5*b* is provided with a large diameter portion 42. A small radial space 7*b* is formed between the circumferential sidewall of the piston 6*b* and the large diameter portion 42 of the connecting rod 5*b*. The space 7*b* allows precession of the connecting rod 5*b* during the reciprocal movement of the piston 6*b*.

When the wobble plate 2 rotates, the rotation of the wobble plate 2 is transmitted to the connecting rod 5*b* through a ball joint for connecting the connecting rod 5*b* to the wobble plate 2 and the connecting rod 5*b* swings beyond the range of the precession. As a result, the large diameter portion 42 of the connecting rod 5*b* swings beyond the small radial space 7*b* to abut the circumferential sidewall of the piston 6*b*, thereby forcing the piston 6*b* and forcing the outer circumferential surface of the piston 6*b* against the inner circumferential surface of the cylinder bore 9. As a result, the swing of the connecting rod 5*b* is prevented and the rotation of the wobble plate 2 is prevented.

In a preferred embodiment shown in FIG. 5, a semispherical portion 8*c* is provided on the other end of a connecting rod 5*c*. A piston 6*c* has a cylindrical shape closed at one end and is provided with a semispherical concave at the closed end. The semispherical portion 8*c* slidably fits in the semispherical concave. A pin 51 passes through the piston 6*c* and the semispherical portion 8*c* to be fixed to the piston 6*c*, thereby connecting the other end of the connecting rod 5*c* to the piston 6*c*. A small amount of play is provided between the pin 51 and the part of the semispherical portion 8*c* through which the pin 51 passes.

The connecting rod 5*c* is provided with a large diameter portion 52. A small radial space 7*c* is formed between the circumferential sidewall of the piston 6*c* and the large diameter portion 52 of the connecting rod 5*c*. The space 7*c* allows precession of the connecting rod 5*c* during the reciprocal movement of the piston 6*c*.

When the wobble plate 2 rotates, the rotation of the wobble plate 2 is transmitted to the connecting rod 5*c* through a ball joint for connecting the connecting rod 5*c* to the wobble plate 2 and the connecting rod 5*c* swings beyond the range of the precession. As a result, the large diameter portion 52 of the connecting rod 5*c* swings beyond the small radial space 7*c* to abut the circumferential side wall of the piston 6*c*, thereby forcing the piston 6*c* and forcing the outer circumferential surface of the piston 6*c* against the inner circumferential surface of the cylinder bore 9. As a result, the swing of the connecting rod 5*c* is prevented and the rotation of the wobble plate 2 is prevented.

In a preferred embodiment shown in FIG. 6, the other end of the piston 5 is fixed to a piston 6*d* and the piston 6*d* is made of flexible material such as resin, etc.

When the connecting rod 5 is fixed to the piston 6*d* and moves unitarily with the piston 6*d*, the connecting rod 5 can precess smoothly and the piston 6*d* can reciprocally move smoothly if only the piston 6*d* is made of flexible material to bend accompanying the precession of the connecting rod 5.

INDUSTRIAL APPLICABILITY

The present invention can be widely used in both variable displacement compressors and fixed displacement compressors.

Figure 1:
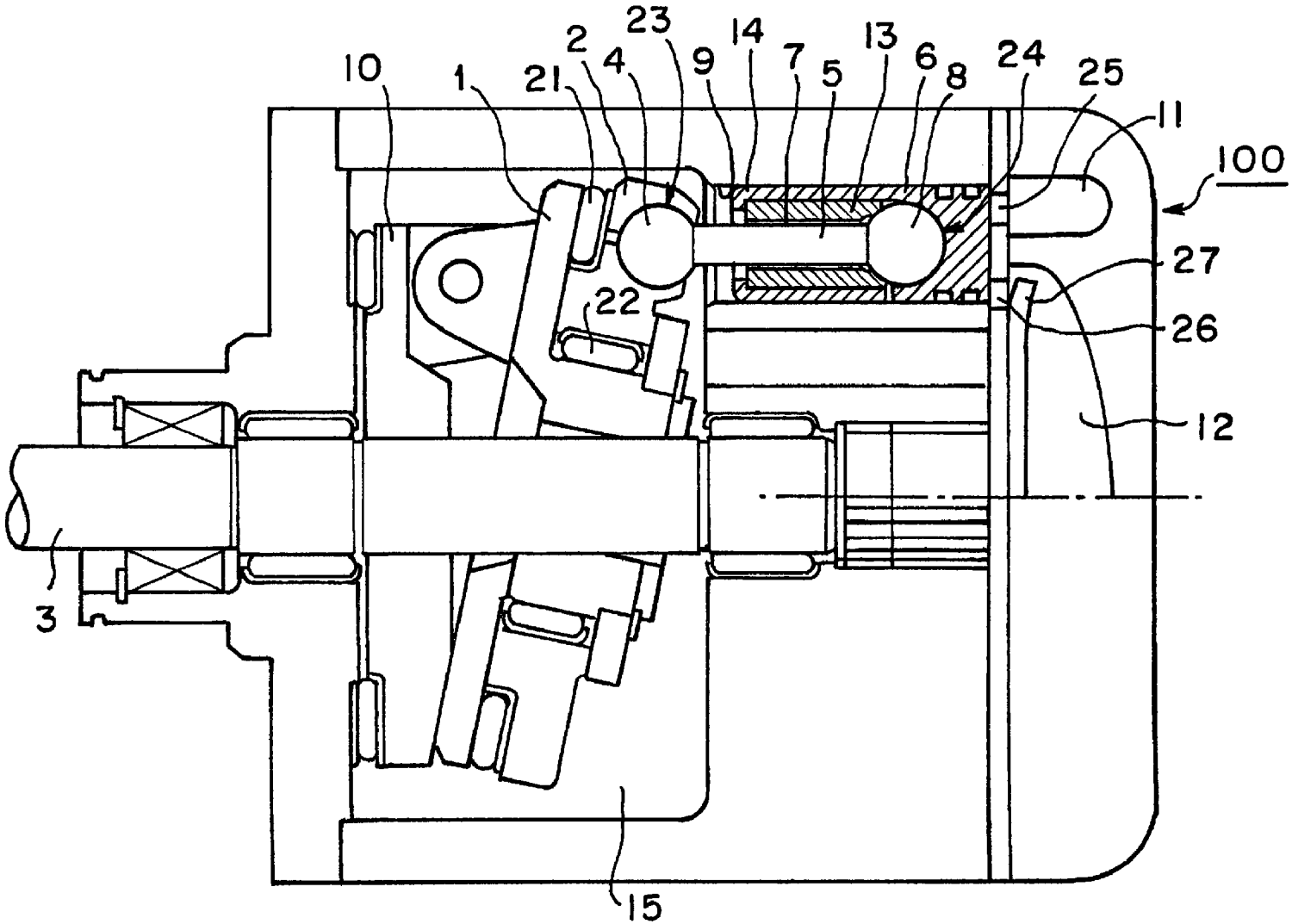
FIG. 1 is a longitudinal sectional view of a variable displacement wobble plate compressor in accordance with a preferred embodiment of the present invention.
Figure 2:
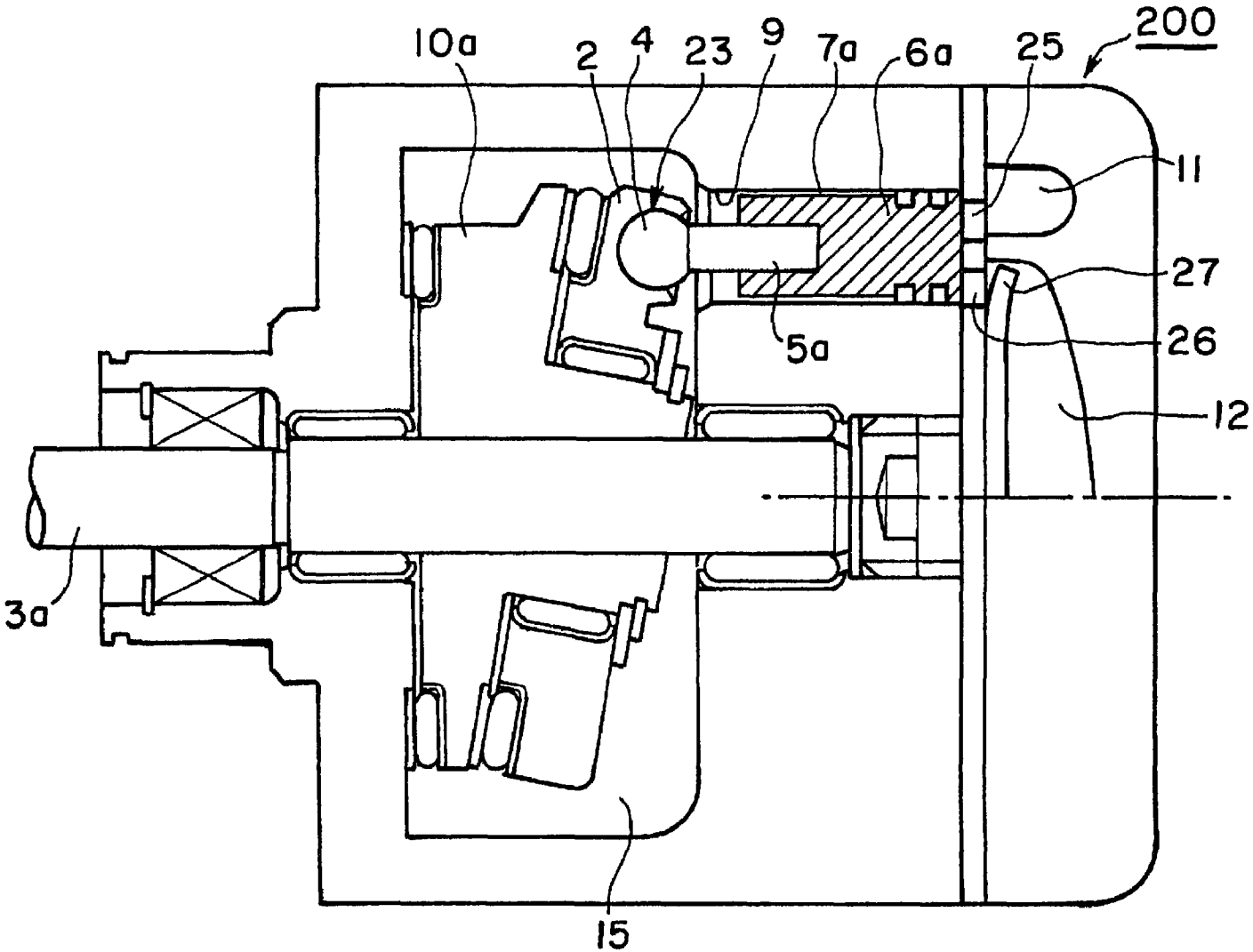
FIG. 2 is a longitudinal sectional view of a fixed displacement wobble plate compressor in accordance with another preferred embodiment of the present invention.
Figure 3:
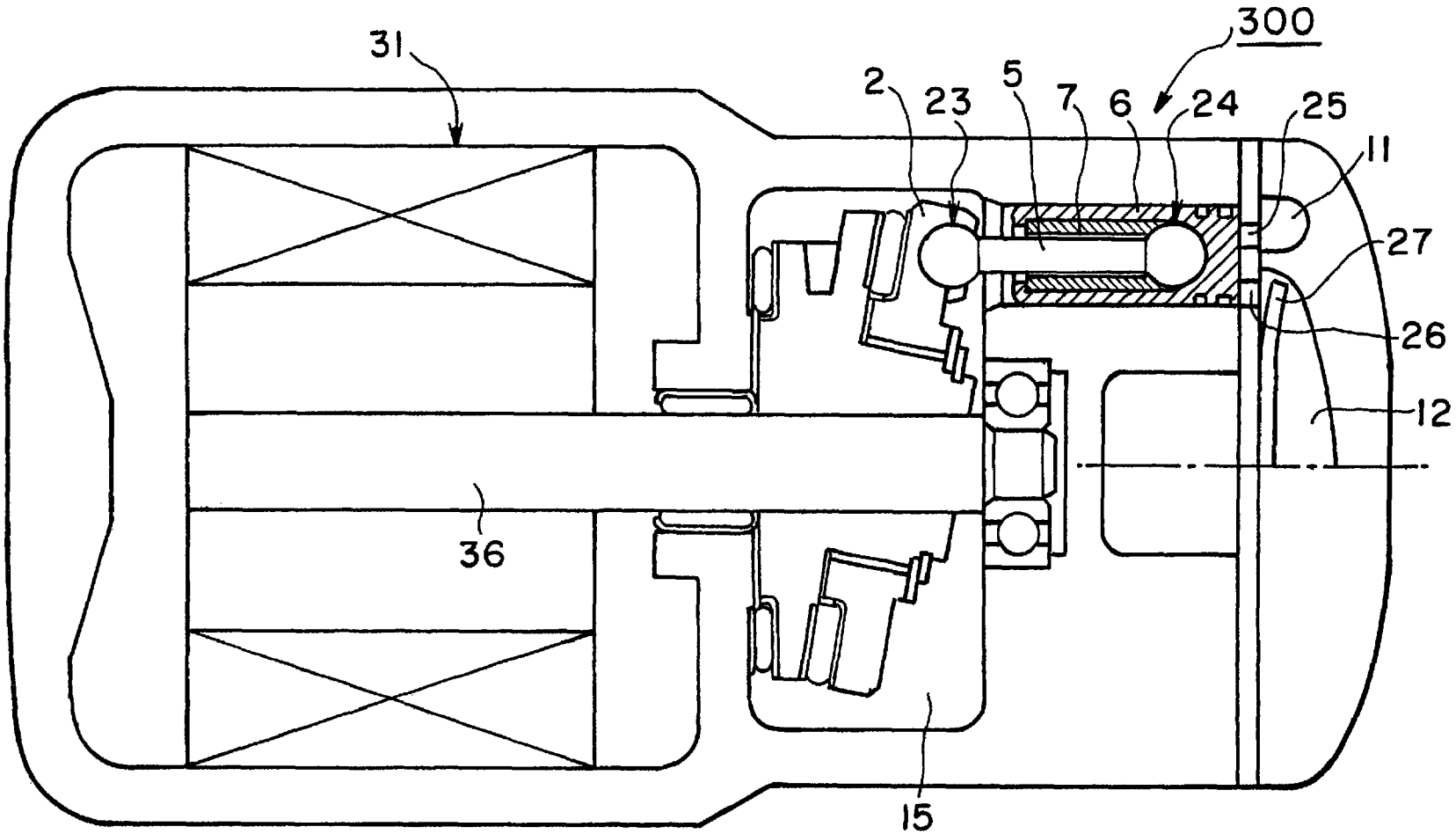
FIG. 3 is a longitudinal sectional view of an electric fixed displacement wobble plate compressor in accordance with another preferred embodiment of the present invention.
Figure 4:
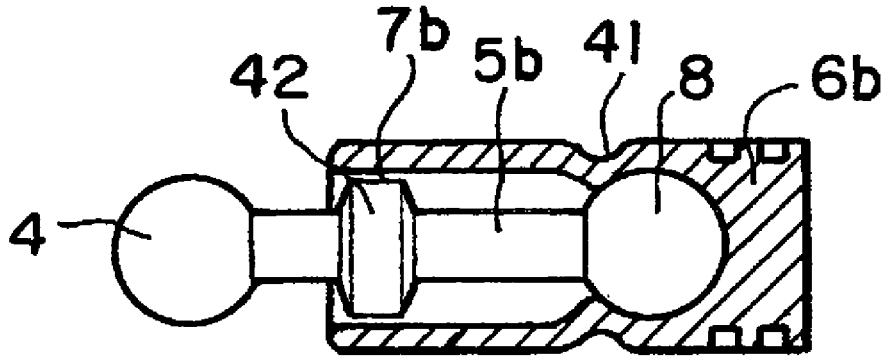
FIG. 4 is a longitudinal sectional view of a connecting rod and a piston of a wobble plate compressor in accordance with another preferred embodiment of the present invention.
Figure 5:
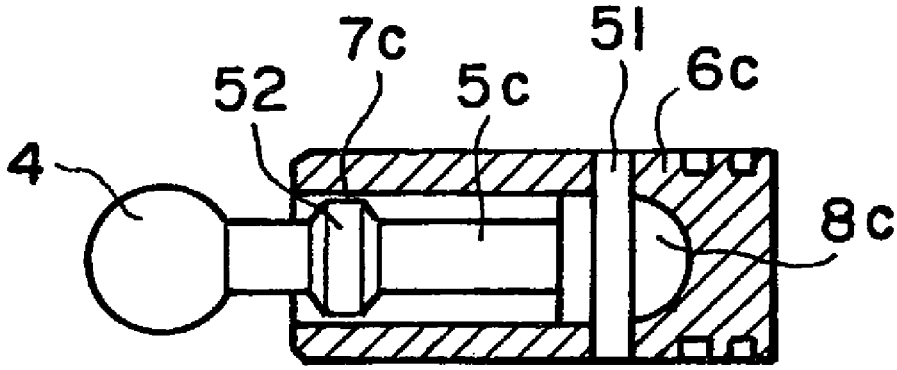
FIG. 5 is a longitudinal sectional view of a connecting rod and a piston of a wobble plate compressor in accordance with another preferred embodiment of the present invention.
Figure 6:
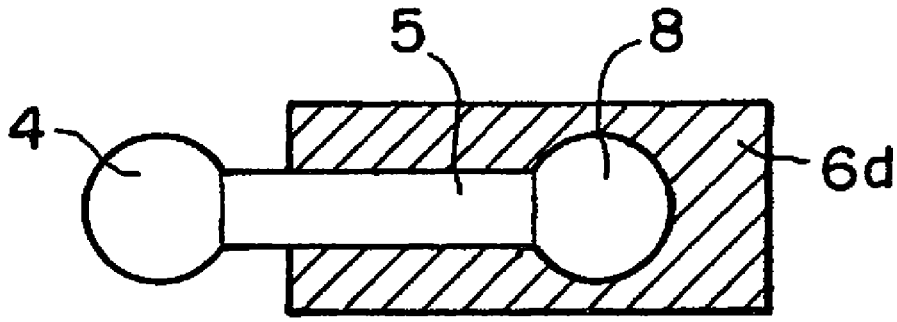
FIG. 6 is a longitudinal sectional view of a connecting rod and a piston of a wobble plate compressor in accordance with another preferred embodiment of the present invention.

The invention claimed is:

1. A wobble plate compressor comprising a main shaft driven by a power source, a wobble plate driven by the main shaft to swing, a piston connected to the wobble plate by a connecting rod, and a cylinder bore extending parallel to the main shaft to accept the piston, wherein the connecting rod is connected to the wobble plate by a ball joint, precession of the connecting rod is allowed when the piston moves reciprocally, and the outer circumferential surface of the piston is forced against the inner circumferential surface of the cylinder bore when the wobble plate is driven by the main shaft to rotate and the connecting rod is driven by the rotating wobble plate to swing beyond the range of the precession, thereby preventing rotation of the wobble plate, wherein the connecting rod is connected to the piston by a ball joint, a radial space is formed between the piston and the connecting rod to allow the precession of the connecting rod when the piston moves reciprocally, and the connecting rod abuts the piston to force it when the connecting rod is driven by the rotating wobble plate to swing beyond the range of the precession, thereby forcing the outer circumferential surface of the piston against the inner circumferential surface of the cylinder bore, and wherein a cylindrical member is fitted in and fixed to the piston to form a part of the piston, and the radial space for allowing the precession of the connecting rod when the piston moves reciprocally is formed between the cylindrical member and the connecting rod.

2. A wobble plate compressor comprising a main shaft driven by a power source, a wobble plate driven by the main shaft to swing, a piston connected to the wobble plate by a connecting rod, and a cylinder bore extending parallel to the main shaft to accept the piston, wherein the connecting rod is connected to the wobble plate by a ball joint, precession of the connecting rod is allowed when the piston moves reciprocally, and the outer circumferential surface of the piston is forced against the inner circumferential surface of the cylinder bore when the wobble plate is driven by the main shaft to rotate and the connecting rod is driven by the rotating wobble plate to swing beyond the range of the precession, thereby preventing rotation of the wobble plate, and wherein the connecting rod is connected to the piston by a pin, a radial space is formed between the piston and the connecting rod to allow the precession of the connecting rod when the piston moves reciprocally, and the connecting rod abuts the piston to force it when the connecting rod is driven by the rotating wobble plate to swing beyond the range of the precession, thereby forcing the outer circumferential surface of the piston against the inner circumferential surface of the cylinder bore.

3. A wobble plate compressor of claim 2, wherein a cylindrical member is fitted in and fixed to the piston to form a part of the piston, and the radial space for allowing the precession of the connecting rod when the piston moves reciprocally is formed between the cylindrical member and the connecting rod.

4. A wobble plate compressor of claim 2, wherein the connecting rod is provided with a portion with large diameter, and the radial space for allowing the precession of the connecting rod when the piston moves reciprocally is formed between the piston and the portion of the connecting rod with large diameter.

5. A wobble plate compressor comprising a main shaft driven by a power source, a wobble plate driven by the main shaft to swing, a piston connected to the wobble plate by a connecting rod, and a cylinder bore extending parallel to the main shaft to accept the piston, wherein the connecting rod is connected to the wobble plate by a ball joint, precession of the connecting rod is allowed when the piston moves reciprocally, and the outer circumferential surface of the piston is forced against the inner circumferential surface of the cylinder bore when the wobble plate is driven by the main shaft to rotate and the connecting rod is driven by the rotating wobble plate to swing beyond the range of the precession, thereby preventing rotation of the wobble plate, and wherein the connecting rod is fixed to the piston, a radial space is formed between the outer circumferential surface of the piston and the inner circumferential surface of the cylinder bore to allow the precession of the connecting rod when the piston moves reciprocally, and the outer circumferential surface of the piston is forced against the inner circumferential surface of the cylinder bore when the connecting rod is driven by the rotating wobble plate to swing beyond the range of the precession, wherein the piston is made of flexible material.

* * * * *